US009863142B2

(12) United States Patent
Stein

(10) Patent No.: US 9,863,142 B2
(45) Date of Patent: Jan. 9, 2018

(54) STIFFENERS FOR METALOG STRUCTURES

(71) Applicant: Alejandro Stein, Crans-Pres-Celigny (CH)

(72) Inventor: Alejandro Stein, Crans-Pres-Celigny (CH)

( * ) Notice: Subject to any disclaimer, the term of this patent is extended or adjusted under 35 U.S.C. 154(b) by 0 days.

(21) Appl. No.: 13/998,995

(22) Filed: Dec. 30, 2013

(65) Prior Publication Data

US 2015/0184377 A1 Jul. 2, 2015

(51) Int. Cl.

| | |
|---|---|
| ***E04B 2/58*** | (2006.01) |
| ***E04B 2/62*** | (2006.01) |
| ***E04C 3/00*** | (2006.01) |
| ***E04B 1/18*** | (2006.01) |
| ***E04B 1/28*** | (2006.01) |
| *E04B 1/24* | (2006.01) |
| *E04B 2/70* | (2006.01) |
| *E04B 1/35* | (2006.01) |

(52) U.S. Cl.

CPC ..... *E04B 2/58* (2013.01); *E04B 1/18* (2013.01); *E04B 1/185* (2013.01); *E04B 1/28* (2013.01); *E04B 2/62* (2013.01); *E04C 3/00* (2013.01); *E04B 2/702* (2013.01); *E04B 2001/2445* (2013.01); *E04B 2001/3583* (2013.01)

(58) Field of Classification Search

CPC ..... E04B 2/58; E04B 2/60

USPC ..... 52/233, 282.2, 282.3, 561–562, 503, 52/283–284, 271, 586.1, 745.1, 745.2, 52/745.21

See application file for complete search history.

(56) References Cited

U.S. PATENT DOCUMENTS 1,210,688 A * 1/1917 Pierce ..... E04B 1/24 147/25
1,219,786 A * 3/1917 Splater ..... E04B 1/10 114/86
1,809,508 A * 6/1931 Colby ..... A63H 33/105 376/459
3,545,128 A * 12/1970 Fontaine ..... A01G 1/08 428/131
4,047,350 A * 9/1977 Chisum ..... 52/592.6
4,619,089 A 10/1986 Stein
4,823,528 A * 4/1989 Faw ..... 52/233
4,897,955 A * 2/1990 Winsor ..... E02D 29/0216 217/65
5,163,259 A * 11/1992 Hunsaker et al. ..... 52/233
5,253,458 A * 10/1993 Christian ..... 52/233
5,277,008 A * 1/1994 Saulez ..... E04B 2/08 52/233
5,282,343 A 2/1994 Stein
5,375,641 A * 12/1994 Schlueter ..... A47G 5/00 160/135

(Continued)

*Primary Examiner* — Beth Stephan

(74) *Attorney, Agent, or Firm* — Donald S. Dowden

(57) ABSTRACT

A plurality of metalogs form a freestanding wall or fence, or structure comprising walls, upper floors whenever applicable and/or roof of a building. Each metalog has an axis. A stiffener extends through a set of aligned holes in the metalogs at right angles to the axes. One or more additional stiffeners may similarly extend through one or more additional sets of aligned holes in the same metalogs. The stiffeners function to resist forces acting in a direction parallel to the axes of the metalogs and therefore enhance the stability of the structure and obviate otherwise required X-bracing.

14 Claims, 4 Drawing Sheets

(56) References Cited

U.S. PATENT DOCUMENTS 5,566,521 A * 10/1996 Andrews ..... E04C 1/40 52/309.17
5,787,675 A * 8/1998 Futagi ..... 52/745.1
5,806,249 A * 9/1998 Helms ..... 52/102
5,881,515 A * 3/1999 George ..... 52/233
5,890,332 A * 4/1999 Skidmore et al. ..... 52/271
5,996,302 A * 12/1999 Choisel ..... 52/586.1
6,266,934 B1 * 7/2001 Houseal ..... 52/233
6,282,859 B1 * 9/2001 Van Der Heijden ..... 52/585.1
6,543,193 B2 * 4/2003 Houseal ..... E04B 2/702 52/233
6,729,084 B2 * 5/2004 Neal ..... 52/233
6,931,803 B1 8/2005 Davis
6,944,998 B1 * 9/2005 King ..... 52/314
8,074,413 B2 12/2011 Stein
8,099,917 B2 1/2012 Stein
8,122,657 B2 2/2012 Stein
8,215,082 B2 7/2012 Stein
8,555,575 B2 10/2013 Stein
8,567,139 B2 10/2013 Stein
2003/0009970 A1 * 1/2003 MacDonald ..... E02D 29/0283 52/562
2004/0187411 A1 * 9/2004 Clegg ..... B44F 9/00 52/233
2006/0096221 A1 * 5/2006 Al-Kahzrajie ..... 52/562
2006/0288654 A1 * 12/2006 Clarke ..... 52/233
2007/0245660 A1 * 10/2007 Scott et al. ..... 52/438
2008/0083177 A1 * 4/2008 Tiberi et al. ..... 52/233
2009/0133345 A1 * 5/2009 Wrightman ..... E04B 2/702 52/233
2009/0188196 A1 * 7/2009 MacDonald ..... 52/562
2009/0293390 A1 * 12/2009 Anderson ..... E04B 2/702 52/233
2011/0239565 A1 * 10/2011 Clarke ..... 52/233
2011/0283639 A1 * 11/2011 Thornton et al. ..... 52/233
2012/0031025 A1 * 2/2012 Cox ..... 52/220.1

* cited by examiner

STIFFENERS FOR METALOG STRUCTURES

BACKGROUND OF THE INVENTION

Field of the Invention

This invention relates to metalogs forming a free-standing wall or fence, or a wall, upper floor or roof of a building, and more particularly to a novel and highly effective stiffener substructure and method for further stabilizing the metalogs so as to obviate otherwise required cross bracing ("X-bracing").

Description of the Prior Art

One of the simplest and fastest methods of constructing freestanding walls and building structures uses hollow "logs". They can be made of various materials, including but not limited to plastic and cardboard, but are usually made of metal and are therefore commonly referred to as "metalogs". Metalogs can be custom-made almost anywhere by a mobile tube-forming machine, or "TFM", in which case the strip material to form the metalogs may be shipped in the form of coils, taking up relatively little volume: The strip can be longitudinally or spirally lock-formed into metalogs. The TFM can be installed on a trailer or barge to reach construction sites. An internal-combustion engine typically powers the TFM, so the metalog fabrication can take place in locations with no infrastructure. This type of construction is ideally suited for employment in remote and rural areas, where requirements for fast-track construction of walls or fences, as well as of residential and non-residential buildings of a quality second to none for a same type of specifications, are often difficult to meet.

In this type of construction, connector elements fitted to the ends of the metalogs-interlock with each other at corners where two structural walls meet, thus providing basic stabilization for the walls. Although metalogs are foreseen to intersect most often on a right angle, there is no problem in varying the connector elements' shape so as to have metalogs intersect at different angles. Connector elements may also be used to connect metalogs forming a roof.

The present applicant is a leading developer of this type of construction, as exemplified by his prior U.S. Pat. Nos. 4,619,089, 5,282,343, 8,074,413, 8,099,917, 8,122,657, 8,215,082, 8,555,575, and 8,567,139, plus numerous patents in other countries. The identified US patents and applications are incorporated herein by reference.

Relatively small wall and building superstructures comprising metalogs can be assembled, start to finish, literally within minutes or hours using unskilled local labor. Larger wall and building structures can also be put together in particularly short times, when comparing with alternative methods of construction. Typically galvanized, aluminized or pre-painted metalogs and other structural components render them impervious to rust, rot, fire and termites, while the combination of continuity and light weight of their structural surfaces renders them less susceptible than masonry and other conventional methods of construction to damage by high winds and earthquakes. A membrane impermeable to water may optionally be applied to the roof to shed rain. Otherwise, the hollow logs can disappear from view underneath internal and/or external cladding with or without thermal insulation incorporated into it.

These considerations have made this type of construction broadly acceptable in various countries for the construction of low-rise buildings and especially as a means of providing, on fast-track mode irrespective of location, free-standing walls and residential and non-residential buildings.

In order to make such free-standing walls and building structures sturdier and resistant to horizontal forces even in the absence of otherwise required X-bracing, there is a need for improvements in design and methods of construction.

OBJECTS AND SUMMARY OF THE INVENTION

An object of the invention is to provide an improved means and method of stiffening metalog structures.

In more detail, objects of the invention include providing a series of stiffeners for an assembly of metalogs that:

enables the metalogs to resist horizontal forces (due for example to wind) all or part of which act in a direction parallel to the axes of the metalogs;

is readily adaptable to existing metalog technology;

requires little expense for parts and labor; and has a mutual relation to the metalogs such that, while the stiffener itself is light and thin and as a standalone item has little resistance to lateral or compressive forces, it affords a surprising stiffness when actually crossing metalogs of a wall or other structure, especially as regards the capability of that wall or other structure to withstand forces having a component acting in a direction parallel to the plane in which it lies.

The foregoing and other objects of the invention are attained by providing, in a structure comprising a plurality of metalogs forming a free-standing wall or fence, or a structure comprising walls, upper floors whenever applicable and/or roof of a building, each metalog having an axis that is typically but not necessarily horizontal, the improvement wherein a stiffener extends through the metalogs to resist forces acting in a direction parallel to the axes of the metalogs, thereby further stabilizing the structure, even without X-bracing.

The stiffener preferably comprises a rod or a tubular element of considerably smaller diameter than the diameter of the metalogs. The ratio of the diameter of the metalogs to the diameter of the rod or tubular element is at least 3 to 1 and preferably approximately 10 to 1. The stiffener is made of metal, wood, or a synthetic material and extends at right angles to the axes of the metalogs.

Connectors respectively support the ends of the metalogs, and the stiffener is spaced apart from the connectors. Depending on the length of the metalogs in a given structure, a plurality of stiffeners spaced apart from the connectors and from one another may be employed.

Each metalog is formed with a pair of spaced-apart holes, the holes of the several metalogs being aligned. The stiffener passes through the aligned holes. In any given metalog, the holes are preferably at diametrically opposite locations.

In an independent aspect of the invention, a method is provided, which comprises the steps of providing a set of metalogs, forming a pair of holes in each metalog of the set, and arranging the metalogs to form at least a part of a free-standing wall or fence, or a wall, upper floor or roof of a building. The holes are aligned, and a stiffener is passed through the holes.

In this method, a rod or a tubular element is preferably employed as the stiffener, the metalogs have respective axes extending parallel to one another, and the stiffener is extended at right angles to the axes. The ends of the metalogs are supported by connectors, and the stiffener is spaced apart from the connectors. Where a plurality of stiffeners are employed, respective stiffeners are extended through the metalogs at locations that are spaced apart from the connectors and from one another. If a stiffener were to coincide with, or pass too near a corner column consisting of a sequence of connector elements, it would not contribute the desired resistance to horizontal forces.

In greater detail, the method comprises forming a plurality of sets of holes in each metalog of the set of metalogs, the holes of each set of holes being at diametrically opposite locations on the respective metalogs, providing first and second connecting means, employing the first connecting means to support the first ends and the second connecting means to support the second ends, spacing a first stiffener a first distance apart from the first connecting means and passing through a first set of aligned holes in the metalogs, and spacing a second stiffener a second distance apart from the first stiffener on a side of the first stiffener opposite the first connecting means and passing through a second set of aligned holes in the metalogs, the second stiffener being a third distance apart from the second connecting means.

BRIEF DESCRIPTION OF THE DRAWINGS

A better understanding of the objects, features, and advantages of the invention can be gained from a consideration of the following detailed description of preferred embodiments thereof in conjunction with the appended figures of the drawing, wherein.

DETAILED DESCRIPTION OF PREFERRED EMBODIMENTS OF THE INVENTION

Figure 1:
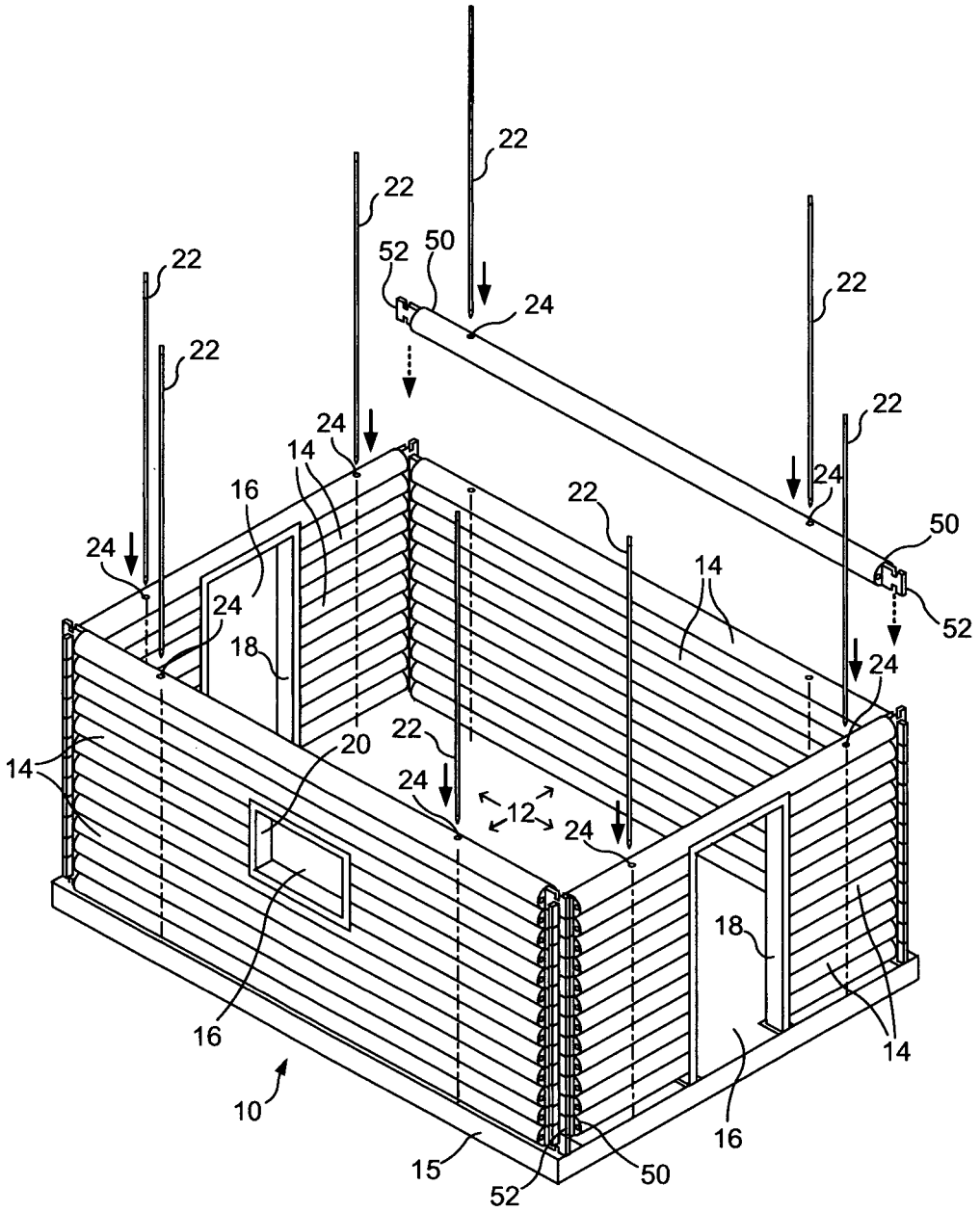
FIG. 1 is an isometric perspective view showing the process of adding metalog stiffeners according to the invention to a metalog superstructure.
Figure 2:
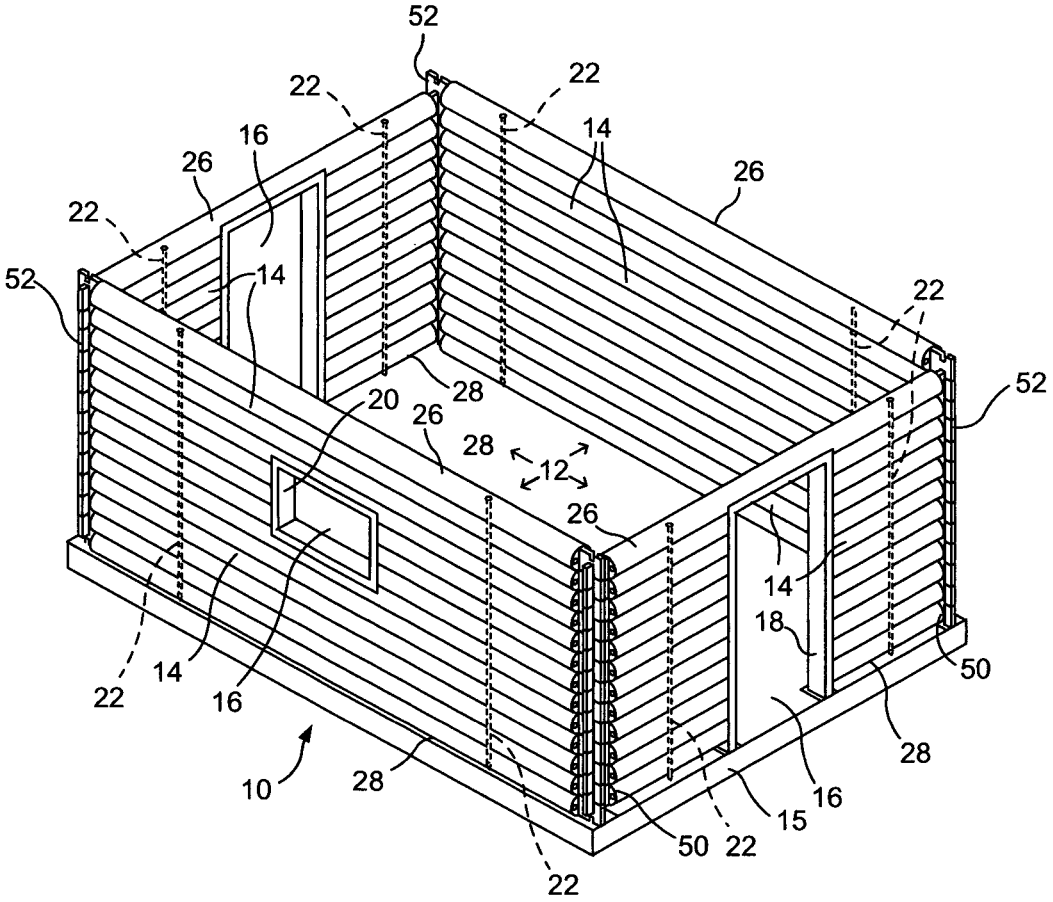
FIG. 2 is an isometric perspective view showing the metalog superstructure of FIG. 1 after the installation of the stiffeners.

FIGS. 1 and 2 show a building superstructure 10 comprising walls 12 formed of metalogs 14 mounted on an optional concrete slab 15. The axes of the metalogs 14 in a given wall 12 are horizontal and parallel to one another. Provision is made for openings 16 for one or more doors 18 and windows 20, plus vents, plumbing and electrical connections and any other required openings (not shown). In accordance with the invention, stiffeners 22 are provided. They are passed through a pair of holes 24 formed in each of the metalogs 14.

FIG. 2 shows the structure of FIG. 1 after installation of the stiffeners 22. Each stiffener 22 extends from the top 26 to the bottom 28 of a wall 12. The stiffeners 22 stiffen the walls 12 of the superstructure 10 as explained below and make it highly resistant to forces generated for example by wind having components parallel to the walls.

Figure 3:
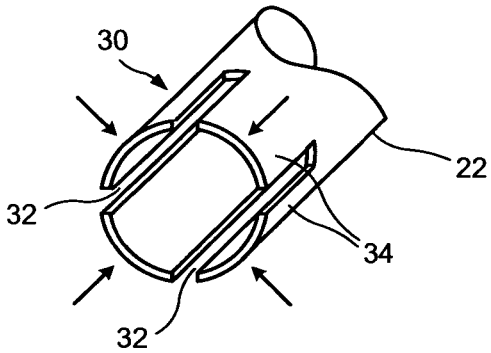
FIG. 3 is an isometric perspective view showing the structure of a preferred embodiment of the lower end of a stiffener facilitating its insertion into holes formed in metalogs as explained below.

As FIG. 3 shows, the stiffeners 22 are preferably configured at the bottom to facilitate entry into the holes 24 formed in the metalogs 14 and speed their installation by unskilled labor. In the illustrated embodiment, the formation 30 resembles a battlement, with crenellations 32 alternating with structure analogous to merlons 34.

Figure 4:
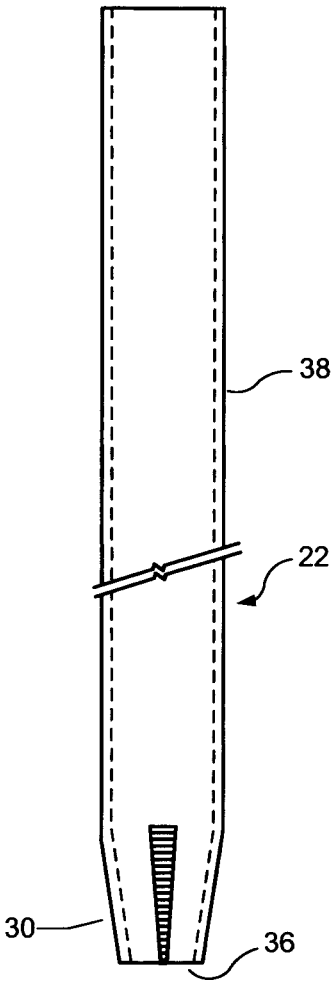
FIG. 4 is an isometric perspective view with a break indicating that a one-piece stiffener can optionally extend from top to bottom of a building superstructure wall.

As FIG. 4 shows, the formation 30 tapers in towards its lower end 36. This facilitates its entry into the holes 24 shown in FIG. 1 while enabling a snug fit (i.e., a fit with little play) of the main portion 38 of the stiffener 22 within the holes 24.

Figure 6:
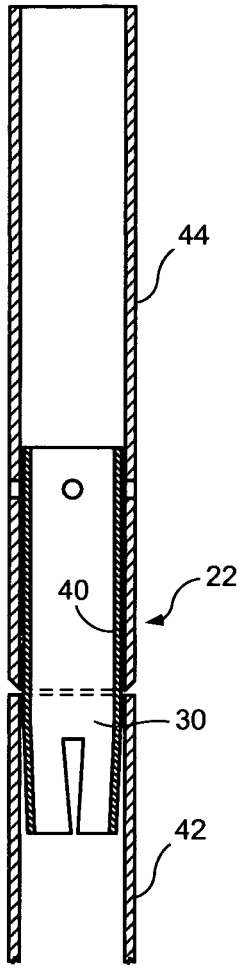
FIG. 6 is an isometric perspective view showing the structure of FIG. 5 after the addition of the extension.
Figure 5:
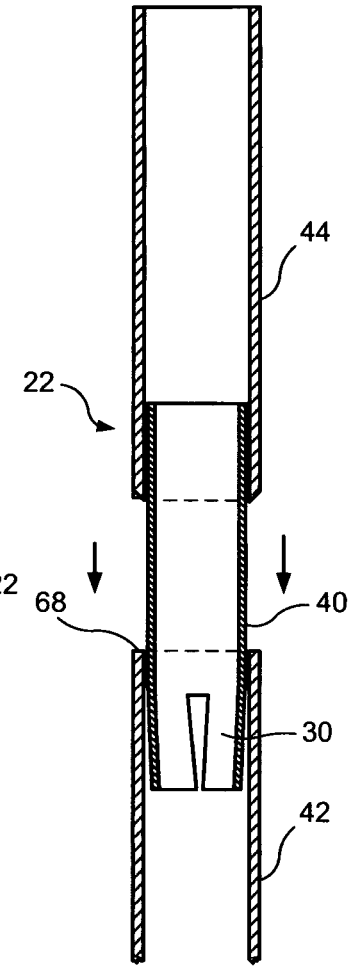
FIG. 5 is an isometric perspective view showing the process of employing the structure of FIG. 3 as a bridge for adding an optional extension to the stiffener of FIG. 4.

FIG. 5 shows a link 40 connecting two sections 42 and 44 that together form a stiffener 22. The link 40 has a tapered battlement-like formation 30 as described above to facilitate its entry into the lower section 42. The link 40 protrudes well above the top 68 of the lower section 42 to provide good support for the upper section 44. FIG. 6 shows the composite stiffener 22 after assembly of the upper and lower sections 42, 44 as described above.

A one-piece stiffener 22 as shown in FIG. 4 is preferred in most cases, but the structure of FIGS. 5 and 6 provides an alternative if the height of the wall 12 or other considerations recommend it.

Figure 7:
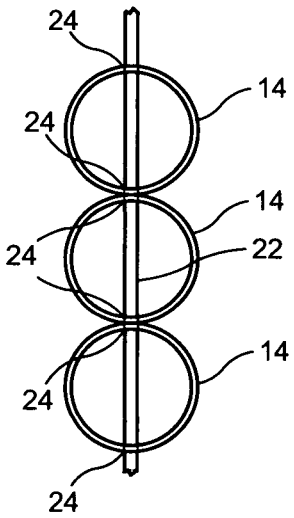
FIG. 7 is an end view of metalogs with a stiffener extending through holes arranged so that, on each metalog, the holes are at diametrically opposite positions, and the holes of one metalog are aligned with those of the others.
Figure 8:
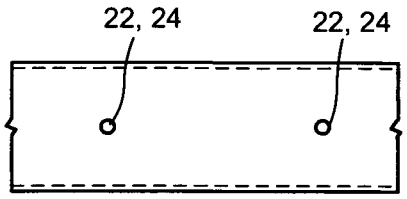
FIG. 8 is a top view of the structure of FIG. 7.

Since the metalogs 24 are substantially cylindrical, they are substantially circular in cross section and, except for oval sections that are also possible, have a diameter in cross section corresponding to the diameter of a circle. (Oval sections have major and minor diameters plus other diametric chords.) FIG. 7 is an end view of metalogs 14 with a stiffener 22 extending through holes 24 arranged so that, on each metalog 14, the holes 24 are at diametrically opposite positions, and the holes 24 of one metalog 24 are aligned with those of the others. FIG. 8 shows the same structure as viewed from above.

Figure 9:
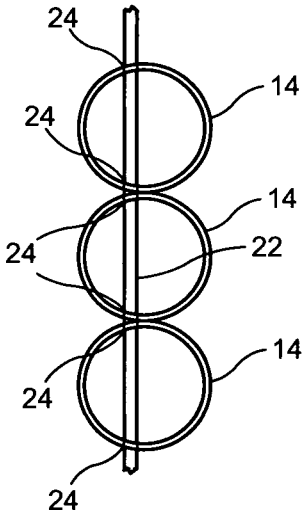
FIG. 9 is an end view of metalogs with a stiffener extending through holes arranged so that, on each metalog, the holes are displaced from diametrically opposite positions, and the holes of one metalog are aligned with those of the others.
Figure 10:
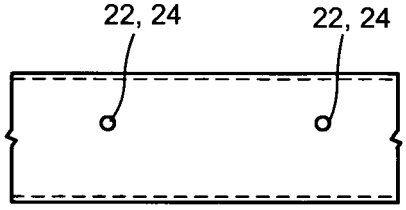
FIG. 10 is a top view of the structure of FIG. 9.

The arrangement of FIGS. 7 and 8 is usually preferred, but the invention also extends to the case of FIGS. 9 and 10, where the stiffeners 22 extend through holes 24 arranged so that, on each metalog 14, the holes 24 are displaced from diametrically opposite positions. In the case of FIGS. 9 and 10, as in the case of FIGS. 7 and 8, the holes 24 accommodating a given stiffener 22 of one metalog 14 are aligned with those of the other metalogs 14 accommodating the same stiffener 22.

Each stiffener 22 comprises a rod or a tubular element of considerably smaller diameter than the diameter of the metalogs. The ratio ratio of the diameter of the metalogs to the diameter of the rod or tubular element is at least 3 and is preferably approximately 10 to 1.

The stiffeners 22 are not subject to compressive loads and partly for that reason they can be made out of relatively thin material. Moreover, the stiffeners 22 do not even require a complete circular section. In other words, they may comprise strip material roll-formed on or off a construction site into tubes with a circular or oval section, without even requiring the longitudinal joint or gap to be closed.

Another reason the stiffeners can be made out of relatively thin material is that they are supported by the metalogs 14, even as they stiffen the structure formed by the metalogs 14.

That is, if the metalogs 14 have a diameter of, say x cm, the stiffeners 22 are supported at intervals that do not exceed x cm in the embodiment of FIGS. 7 and 8 and that are even less in the embodiment of FIGS. 9 and 10. The stiffeners 22 when engaged with the metalogs 14 as described herein impart a stiffness to the structure formed by the metalogs 14 that is quite surprising and out of proportion to the light weight of the stiffeners 22.

The stiffeners 22 can be made of metal, wood, or a synthetic material and extend at right angles to the axes of the metalogs.

As FIGS. 1 and 2 show, the metalogs 14 have opposite ends 50. Corner connectors 52 respectively support the ends 50, and the stiffeners 22 are spaced apart from the ends 50 and connectors 52. Where multiple stiffeners 50 are employed in a given wall, as illustrated in FIGS. 1 and 2, the stiffeners 22 are spaced apart from the connectors 52 and from one another.

In greater detail, a method according to the invention comprises the steps of spacing a first stiffener a first distance apart from the first connecting means, as illustrated in the back wall in FIG. 2 by the separation between either stiffener 22, say the nearer one, and the nearest corner connectors 52, the first stiffener passing through a first set of aligned holes 24 in the metalogs 14; and spacing a second stiffener a second distance apart from the first stiffener on a side of the first stiffener opposite the first connecting means, as illustrated in the back wall in FIG. 2 by the separation between the two stiffeners in that wall, the second stiffener passing through a second set of aligned holes in the metalogs and being a third distance apart from the second connecting means, as illustrated in the back wall in FIG. 2 by the separation between the second stiffener and the second connecting means (i.e., the corner connectors 52 in the far corner of FIG. 2).

Thus there is provided in accordance with the invention a novel and highly effective structure and method for further stabilizing metalogs so as to obviate X-bracing. The invention provides an improved means and method of stiffening metalog structures.

The invention provides a stiffener for an assembly of metalogs that enables the metalogs to resist forces (due for example to wind) that act in a direction parallel to the axes of the metalogs. It is readily adaptable to existing metalog technology and requires little expense for parts and labor. Moreover, it has a mutual relation to the metalogs such that, while the stiffener itself is light and thin and as a standalone item has little resistance to lateral or compressive forces, it affords a surprising stiffness to the wall or other structure comprising the metalogs, especially as regards the ability of that structure to withstand forces having a component acting in a direction parallel to the plane in which it lies.

Many modifications of the preferred embodiments of the invention disclosed herein will readily occur to those having ordinary skill in the art. The invention extends to all embodiments thereof that are within the scope of the appended claims.

The invention claimed is:

1. A structure comprising:

a plurality of intersecting hollow metalogs forming a freestanding wall or fence, or at least one of a wall, upper floor and roof of a building structure, each of the metalogs having an axis, ends, holes formed at locations spaced apart from the ends, and a diameter, corner connectors attaching the metalogs to each other at their respective ends, and a stiffener comprising a rod or a tubular element of smaller diameter than the diameter of the metalogs and not being subject to compressive loads, the rod or tubular element extending from top to bottom of the structure and with a snug fit through the holes formed in the metalogs to resist horizontal forces and thereby to enhance the stability of the structure.

2. A structure according to claim 1 wherein the stiffener is in a plurality of pieces, further comprising a link connecting the pieces.

3. A structure according to claim 1 wherein the ratio of the diameter of the metalogs to the diameter of the rod or tubular element is at least 3 to 1.

4. A structure according to claim 3 wherein the ratio is approximately 10 to 1.

5. A structure according to claim 1 wherein the stiffener is made of metal, wood, or a synthetic material.

6. A structure according to claim 1 wherein the axes of the metalogs are horizontal and the stiffener extends at right angles to the axes of the metalogs.

7. A structure according to claim 1 wherein the stiffener is in one piece.

8. A structure according to claim 1 comprising a plurality of stiffeners spaced apart from the connectors and from one another.

9. A structure according to claim 1 wherein each of the metalogs is formed with the holes being at least a pair of spaced-apart holes, the holes of each of the metalogs being aligned and the stiffener passing through the holes.

10. A structure according to claim 1 wherein each of the metalogs is formed with the holes being at least a pair of holes at diametrically opposite locations, the holes of each of the metalogs being aligned and the stiffener passing through the holes.

11. A method comprising the steps of:

providing a set of hollow metalogs each of the metalogs having an axis and ends, providing a set of corner connectors supporting the metalogs at each of the ends, forming a first pair of holes in each of the metalogs of the set at a location spaced apart from the ends, arranging the metalogs to form at least a part of a free-standing wall or fence, or at least one of a wall, upper floor and roof of a building structure, aligning the first pair of holes, providing a first rod or tubular element, configuring the first rod or tubular element to pass through the first pair of holes, and passing the first rod or tubular element with a snug fit through the first pair of holes, the rod or tubular element extending from top to bottom of the free-standing wall or fence, or at least one of a wall, upper floor and roof of a building structure and not being subject to compressive loads.

12. A method according to claim 11 comprising the steps of:

forming a second pair of holes in each of the metalogs of the set of metalogs at a location spaced apart from the ends and from the first pair of holes, aligning the second pair of holes, providing a second rod or tubular element, configuring the second rod or element to pass through the second pair of holes, and passing the second rod or tubular element with a snug fit through the second pair of holes, the second rod or tubular element extending from top to bottom of the free-standing wall or fence, or at least one of a wall, upper floor and roof of a building structure and not being subject to compressive loads.

13. A method according to claim 11 comprising the step of forming the rod or tubular element of metal.

14. A method according to claim 11 wherein the respective axes extend parallel to one another, comprising the step of extending the stiffener at right angles to the axes.

* * * * *